US005397434A

United States Patent [19]

Costa et al.

[11] Patent Number: 5,397,434

[45] Date of Patent: Mar. 14, 1995

[54] METHOD FOR DISTRIBUTING CELLULOSIC PULP THROUGH A REACTOR AT A CONSTANT UPWARD VELOCITY

[75] Inventors: Danilo S. Costa; Pedro M. Pita, both of Sao Paulo, Brazil; Vincent L. Magnotta, Wescosville, Pa.

[73] Assignee: Air Products and Chemicals, Inc., Allentown, Pa.

[21] Appl. No.: 189,234

[22] Filed: Jan. 27, 1994

Related U.S. Application Data

[62] Division of Ser. No. 895,490, Jun. 8, 1992.

[51] Int. Cl.[6] ..... D21C 5/02; D21C 7/06; D21C 7/08

[52] U.S. Cl. ..... 162/4; 162/6; 162/52; 162/65

[58] Field of Search ..... 162/17, 19, 52, 65, 162/237, 246, 4, 6; 422/232, 233; 8/156

[56] References Cited

U.S. PATENT DOCUMENTS

| | | | |
|---|---|---|---|
| 1,776,761 | 9/1930 | Morterud . | |
| 2,198,587 | 4/1940 | Skinner | 214/17 |
| 3,313,678 | 4/1967 | Rydin | 162/19 |
| 3,397,718 | 8/1968 | Jones | 137/605 |
| 3,660,225 | 5/1972 | Verreyne et al. | 162/17 |
| 3,992,248 | 11/1976 | Hurter | 162/17 |
| 4,886,577 | 12/1989 | Wiley | 162/52 |
| 5,034,095 | 7/1991 | Kido et al. | 162/17 |

FOREIGN PATENT DOCUMENTS

| | | |
|---|---|---|
| 2202188 | 6/1990 | Australia . |
| 868664 | 11/1986 | South Africa . |

*Primary Examiner*—Steve Alvo

*Attorney, Agent, or Firm*—John M. Fernbacher; William F. Marsh

[57] ABSTRACT

Method for the treatment of cellulosic pulp in which pulp is distributed upward through a vertical reactor using a unique conical distributor and is discharged using a unique dilution method to eliminate plugging. The system is particularly useful for delignifying virgin wood pulps or decolorizing pulps made from waste paper materials.

13 Claims, 3 Drawing Sheets

METHOD FOR DISTRIBUTING CELLULOSIC PULP THROUGH A REACTOR AT A CONSTANT UPWARD VELOCITY

This is a division, of application Ser. No. 07/895,490 filed Jun. 8, 1992.

FIELD OF THE INVENTION

This invention pertains to the treatment of cellulosic pulp and in particular to a reactor system and a method for removing lignin or color from virgin or secondary pulp by reaction with oxygen or ozone.

BACKGROUND OF THE INVENTION

Oxygen delignification is a well-known process for removing lignin from wood pulp by treatment with oxygen and alkali followed by washing to remove soluble oxygen-lignin reaction products. The oxygen delignification reactions are typically carried out by mixing oxygen with medium consistency, heated alkaline pulp and passing the resulting mixture through a reactor with a sufficient contact time to allow the reaction to proceed to the desired degree. One type of reactor used for delignification is a vertical upflow reactor in which the pulp-oxygen mixture is introduced into the bottom of the reactor, flows upward while the reactions take place, and treated pulp is withdrawn from the top of the reactor.

The reactor feed mixture can be prepared by methods known in the art. U.S. Pat. No. 4,886,577 discloses the use of a specifically-designed centrifugal pump in which a pulp slurry is degassed by vacuum while passing through the pump, followed by addition of oxygen directly into the pulp at the pump discharge utilizing a shear plate or an oxygen permeable material which causes the oxygen to be introduced as small bubbles. South African Patent Application 868664 describes an alternate method to introduce oxygen into pulp which comprises passing the heated pulp in a completely fluidized state through an unobstructed flow path where it is contacted with highly dispersed oxygen bubbles ranging from 2 to 10 microns in diameter. This patent application also summarizes earlier alternative methods for oxygen dispersion described in the prior art. Australian Patent Application 22021/88 describes a similar method for introducing oxygen or oxygen-steam mixtures into the pulp.

In oxygen delignification at temperatures typically in the range of 80° to 120° C., the amount of oxygen required for delignification is much larger than the amount of oxygen soluble in the liquor associated with a given amount of pulp. In order to supply sufficient oxygen for delignification in the reactor, it is therefore necessary to incorporate bubbles of free oxygen gas in the pulp introduced to the reactor. It is desirable that these bubbles be very small in order to maximize the interfacial area so that additional oxygen can dissolve in the liquor as dissolved oxygen is consumed in the delignification reactions. The reactor system should be designed to achieve a constant upward flow velocity at all radial locations in the reactor, i.e., plug flow. Deviations from plug flow, in which some portions of the pulp move at a higher velocity and thus have less residence time in the reactor than other portions of the pulp, will cause uneven delignification and poor product quality. Careful design of the inlet and outlet sections of the reactor is necessary, since both sections influence pulp flow distribution throughout the reactor.

U.S. Pat. No. 5,034,095 discloses an upflow reactor for oxygen delignification comprising a cylindrical vessel having conical chambers connected to the inlet (bottom) and outlet (top) of the reactor wherein pulp is introduced and withdrawn at the axial center of the respective conical chambers. The convergence angle of each conical chamber, also defined as the included angle, is less than 60 degrees, preferably 20–60 degrees. No device to aid in pulp distribution or withdrawal is used in either the inlet chamber or the outlet chamber. This patent also describes a type of prior art reactor which utilizes a rotating mechanical distributor at the inlet and a mechanical discharge device at the outlet to aid in distribution and withdrawal of pulp from the reactor. These mechanical devices, which are widely used in commercial reactor systems, are effective for pulp feed distribution and withdrawal but can increase capital and maintenance costs for such reactor systems.

Improved reactor designs for oxygen delignification are desirable to achieve consistent product homogeneity and minimize the capital and operating costs of the reactor system. Such designs should emphasize operating simplicity and minimize complex design features. The reactor system of the present invention described and claimed below satisfies these requirements and offers improvements over prior art reactor systems.

SUMMARY OF THE INVENTION

The present invention is a reactor system for the chemical treatment of cellulosic pulp comprising one or more reactors, wherein each reactor includes a vertical, cylindrical vessel having a lower end and an upper end, a frusto-conical bottom chamber joined at the base to the lower end of the vessel, and piping means for introducing a mixture of untreated cellulosic pulp and treatment chemicals axially into the bottom chamber. Oxygen and ozone are preferred treatment chemicals. A distributor comprising a cone is located coaxially within the bottom chamber; the vertex of the cone is oriented downward, and the distributor operates in conjunction with the bottom chamber to promote flow of the pulp-oxygen mixture upward through the cylindrical vessel at a constant velocity. A head connected to the upper end of the cylindrical .vessel includes means for withdrawing treated cellulosic pulp from the reactor system which comprises a plurality of regularly placed nozzles for injecting liquid to dilute the pulp for easy withdrawal. The feed distributor at the lower end and the withdrawal means at the upper end of the reactor operate in combination to maintain plug flow of pulp and oxygen through the reactor, thus ensuring even delignification and a homogeneous product. The feed distributor allows quiescent flow of pulp and dispersed oxygen, thus eliminating the potential for oxygen bubble coalescence caused by mechanical distribution devices.

DETAILED DESCRIPTION OF THE INVENTION

Figure 1:
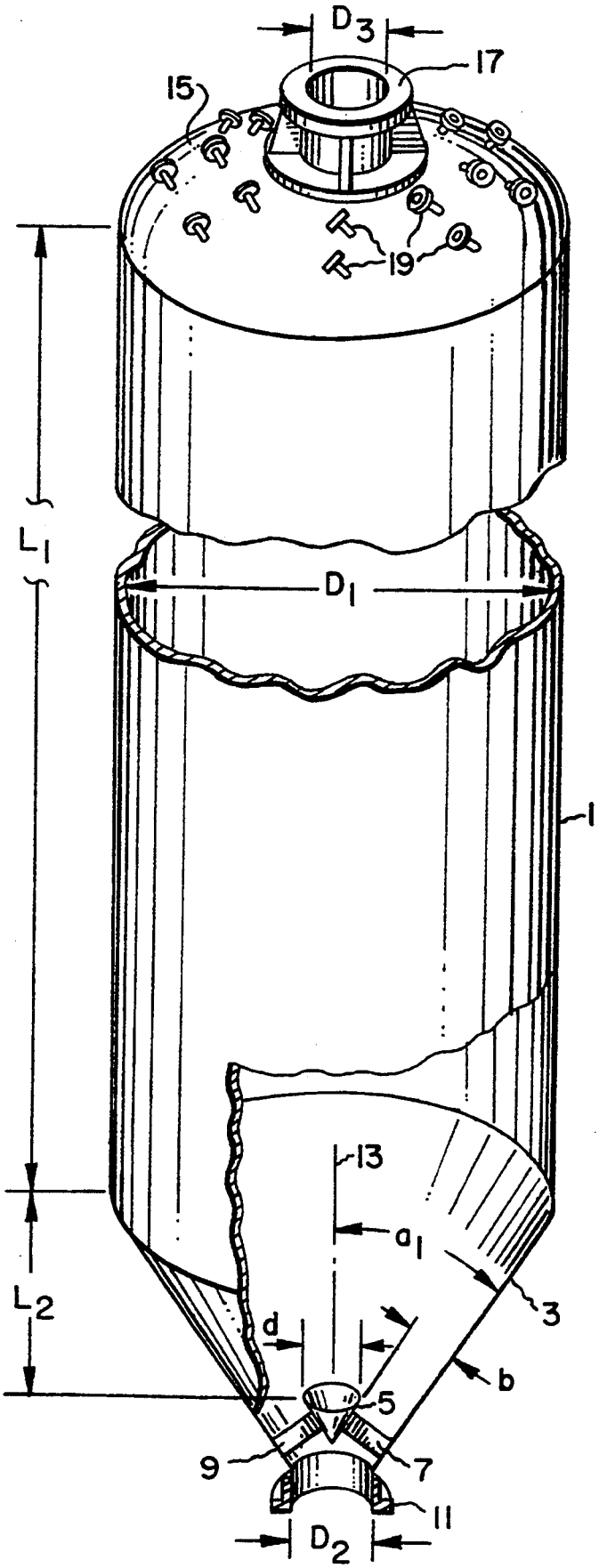
FIG. 1 is a sectional isometric drawing of the reactor of the present invention.

The invention is a reactor system for the chemical treatment of cellulosic pulp as shown in the sectional isometric drawing of the reactor portion of the system shown in FIG. 1. Cylindrical vessel 1 is equipped with frusto-conical bottom chamber 3 in which inverted cone 5 is located coaxially near the small end of the bottom chamber. Vessel i has a length to diameter ratio $L_1/D_1$ between about 5 and 10, preferably between about 6.5 and 8.0. Cone 5 is a solid cone attached to the inner surface of bottom chamber 3 by at least two brackets 7 and 9; preferably three or more brackets are used. Flanged opening 11 is attached to the small end of the bottom chamber and serves as the pulp inlet. Angle $a_1$ is between about 30 and 45 degrees, so that the included angle or convergence angle of the frusto-conical bottom chamber is between about 60 and 90 degrees, preferably about 70 degrees. The included angle of cone 5 is generally equal to the included angle of bottom chamber 3, and cone 5 is preferably located near the inlet of bottom chamber 3 but may be located at any point along axis 13 within bottom chamber 3. The diameter of the base of cone 5 and $L_2$, the axial distance between the bases of cone 5 and bottom chamber 3, are selected such that the ratio $L_2/d$ is between about 3 and 7, preferably between about 4.2 and 5.4. Perpendicular distance b between the walls of bottom chamber 3 and cone 5 is fixed by the values of $L_2$ and d, and is preferably between about 200 and 300 mm depending upon diameter $D_1$of cylindrical vessel 1. The ratio of the vessel diameter $D_1$ to the cone base diameter d is between about 4 and 10, preferably between about 6 and 8.

The combined bottom chamber 3 and cone 5 serve as the distributor for pulp and treating chemicals entering the reactor through flanged opening 11. When the treating chemicals include highly dispersed bubbles of reactive gases such as oxygen or ozone, it is highly desirable that these bubbles remain small; the reactor system therefore should be designed to minimize bubble coalescence, since larger bubbles have less interfacial area and can promote undesirable channelling in the reactor. The design of bottom chamber 3 and cone 5 allows the flow and distribution of pulp into the reactor with minimum disturbance, thereby minimizing bubble coalescence.

Head 15 having a generally ellipsoidal or dished shape is attached to the upper end of vessel i and includes a concentric flanged outlet 17 for removal of treated pulp and a plurality of nozzles 19 for injecting a suitable aqueous liquid, such as for example washer filtrate, into the pulp to reduce pulp consistency which aids pulp withdrawal and eliminates plugging. The generally ellipsoidal or dished shape of the head is selected based on typical pressure vessel design practices as known in the art. The liquid is supplied at the necessary pressure by known pumping means. Nozzles 19 project through head 15 and are installed at angles to the surface of head 15 as illustrated in FIG. 1. The inside diameter $D_6$ of each nozzle is typically between about 30 and 70 mm, and each nozzle extends into head 15 a distance of between about 100 and 300 mm. The ratio $D_6/D_1$ between the inside diameter of each nozzle and the diameter of vessel 1 is typically between about 0.008 and 0.020. The angled orientation of nozzles 19 serves to impart a moderate degree of beneficial circular or swirling motion to the pulp during withdrawal through outlet 17. Nozzles 19 are preferably installed in one or more circular patterns concentric with the axis of vessel 1, wherein the nozzles on a given circular pattern are equally spaced on the pattern. At least eight nozzles are generally preferred, but any reasonable number may be installed as needed. Typically 16 nozzles are installed in two circular patterns as illustrated in FIG. 1.

Figure 2:
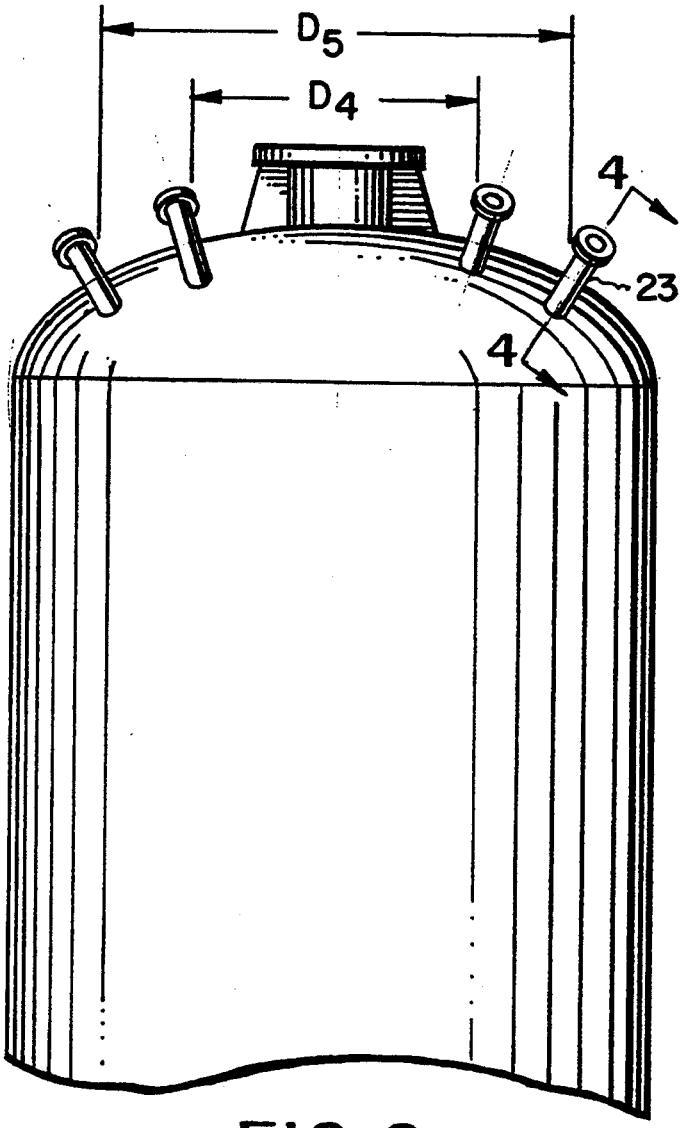
FIG. 2 is a sectional drawing of the upper portion of the reactor of the present invention.
Figure 3:
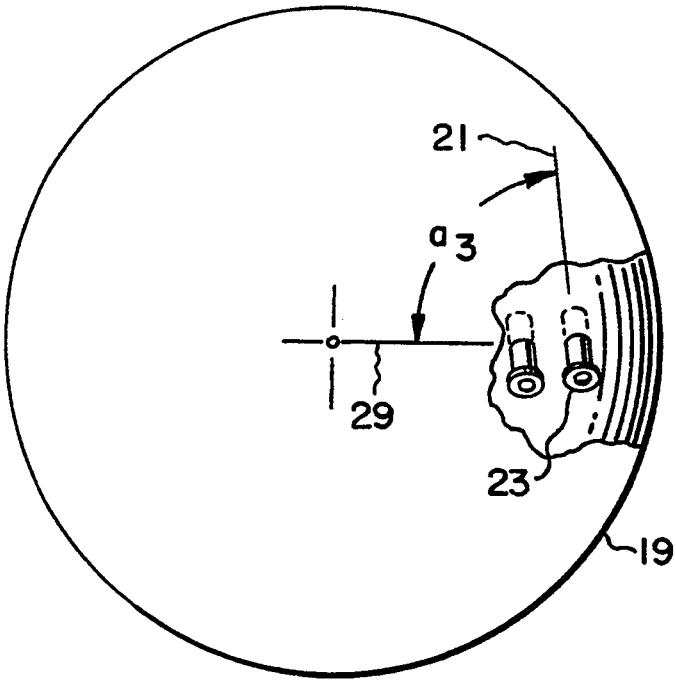
FIG. 3 is a top view of the reactor of the present invention showing a portion of the head and nozzles.
Figure 4:
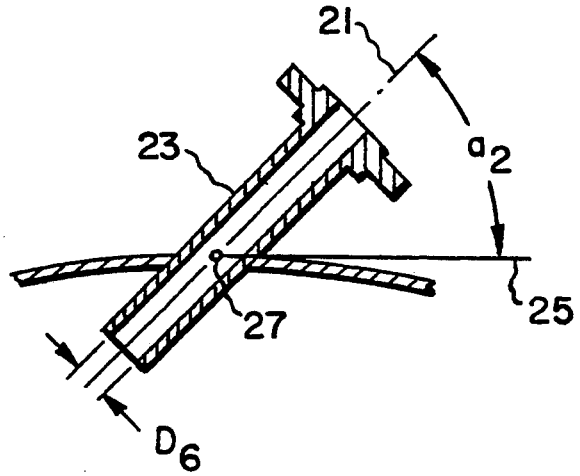
FIG. 4 is a cross-sectional view of a nozzle in the head of the reactor of the present invention.

Nozzles 19 are oriented relative to head 15 as illustrated in FIG. 2, and section 4-4 is presented in FIG. 4. Angle $a_2$ is between about 25 and 65 degrees, preferably about 45 degrees, as measured between tangent 25 and axis 21 of specific nozzle 23. Tangent 25 is a line drawn tangent to the circle formed by the circular pattern at the location of nozzle 23, or more specifically at the intersection 27 of axis 21 and the circle formed by the circular pattern of nozzles. Because of the curvature of head 15, a second angle must be defined to fix the exact orientation of each nozzle. FIG. 3, which is a top sectional view of head 19, illustrates angle $a_3$ formed by axis 21 of nozzle 23 and radial line 29; this angle is less than 90 degrees and greater than 45 degrees, and depends upon the radial distance of the nozzle from the axis of vessel 1. Radial line 29 is a radial line drawn perpendicularly from the axis of vessel 1 through point 27 of FIG. 4. All nozzles are angled to discharge in the same general circumferential direction as illustrated in FIG. 1.

The diameters $D_2$ and $D_3$ of inlet 11 and outlet 17 respectively are selected relative to vessel diameter $D_1$ such that the ratios $D_2/D_1$ and $D_3/D_1$ are between about 0.12 and 0.20. The diameters $D_4$ and $D_5$ of the circular patterns of nozzles 19 are typically selected such that the ratios $D_4/D_1$ and $D_5/D_1$ are between about 0.3 and 0.8. Bottom chamber 3 and cone 5 act in combination with the dilution nozzles in the reactor head to ensure even plug flow of the pulp upward through the reactor, which in turn ensures a highly homogeneous pulp product.

The reactor described above is useful for the treatment of any type of cellulosic pulp including virgin pulp prepared from wood chips or secondary pulp prepared from waste paper material. The pulp can be prepared by means well-known in the art, and can be subjected to prior process steps such as disintegration, screening, delignification by sulfate or other chemical processes, and other known steps. Pulp entering the reactor therefore comprises cellulosic fibers containing lignin and/or other color-causing materials, water, soluble treatment chemicals such as soluble alkaline compounds, and optionally dispersed oxygen, ozone, or other reactive gases. Certain types of secondary pulp may also contain contaminants such as binders, polymers, polymeric inks, adhesives, and the like. When oxygen is used for treating virgin pulp, the oxygen reacts with lignin to form reaction products removable in succeeding washing steps. When oxygen is used for treating pulp prepared from waste paper material, lignin and/or color bodies and/or other contaminants react with the oxygen to form suspended and/or soluble reaction products removable in subsequent washing, screening, or deinking steps. The reactor of the present invention may be used in a single stage configuration.,, or may be used in two or more stages for series treatment of pulp at different process conditions.

The reactor of the present invention is particularly useful in medium consistency (5 to 20%, preferably 8 to 14% consistency) oxygen delignification in which oxygen is dispersed as fine bubbles in the pulp prior to entering the reactor. In oxygen delignification, it is important that the small oxygen bubbles remain dispersed while the pulp flows upward through the reactor during which the oxygen dissolves in the liquor and reacts with the lignin or other color-causing materials to yield reaction products which are washed from the pulp in subsequent steps. Oxygen dosage is typically 0.1 to 5 wt % on oven-dried pulp. The feed distribution achieved by bottom chamber 3 and cone 5 allows quiescent flow of pulp and dispersed oxygen into the reactor, thus eliminating the potential for oxygen bubble coalescence which could be caused by mechanical distribution devices.. Pulp reactor residence time for oxygen bleaching is typically between about 45 and 60 minutes. For ozone bleaching, reactor residence times range from 0.5 to 10 minutes; dosage is typically between 0.05 and 1.0 wt % on oven-dried pulp.

Removal of treated pulp is accompanied by the injection of an aqueous liquid, such as for example washer filtrate, through nozzles 19 at a suitable flow rate to dilute the pulp such that the ratio of the consistency after dilution to the consistency before dilution is between about 0.5 to 0.75. For example, a pulp with a consistency of 12% would be diluted to a consistency of between 6 and 9% prior to withdrawal from the reactor. This liquid injection also induces a moderate degree of beneficial circular or swirling motion to the pulp during withdrawal through outlet 17. The dilution of the pulp upon withdrawal serves two purposes: first, it ensures even flow distribution of the pulp through the reactor in conjunction with bottom chamber 3 and cone 5, and second, it eliminates the possibility of plugging when withdrawing pulp through the reactor head 15 and outlet 17. The liquid injected through nozzles 19 provides an excellent means for the introduction of additional treating chemicals such as surfactants, enzymes, acids, chelants, or other compounds if required in downstream process steps.

EXAMPLE

The application of the reactor system described above to medium consistency oxygen delignification is illustrated by the following Example. Steam and alkali are added to 1100 metric tons/day of medium consistency kraft pulp at the suction of a Kaymr MC Model 15 pump. Oxygen is injected into the discharged pulp by means of porous diffusers. The oxygenated pulp is reheated by steam injection to 92° C. and flows into the reactor of FIG. 1 at a pressure of 121 psig through bottom chamber 3 by which it is distributed into reaction vessel 1. At this point, the pulp has a consistency of 12.0%, a pH of 12.5, a Kappa no. of 15, and contains 15 kg of oxygen per metric ton of air dried pulp. The mixture of pulp, alkali, and oxygen flows upward through the reactor at a residence time of 50 minutes. At the top of the reactor but prior to dilution, the pulp temperature is 95° C. due to the exothermic delignification reaction and the pressure is 60 psig. Pulp filtrate is injected through 16 nozzles, each 38 mm I.D., in the reactor head as illustrated in FIG. 1 to dilute the pulp to a consistency of 7.5%, which cools the diluted pulp to 85° C., and the pulp is withdrawn through discharge pipe 17. The delignified pulp, which now has a Kappa no. of 9.0, is ready for washing and bleaching prior to the final papermaking step.

The reactor of the present invention differs from prior art reactors and has several unique features and advantages over such reactors. First, the present reactor utilizes no mechanical devices for pulp feed, distribution, or discharge. This reduces capital and operating costs, and also introduces no agitation which could cause the small, dispersed oxygen bubbles to coalesce. As earlier described, coalescence is undesirable because it reduces the oxygen gas interfacial area, thus reducing the oxygen dissolution rate and therefore the delignification rate. In addition, large oxygen bubbles in the reactor may induce channeling resulting in a nonhomogeneous product. The reactor also differs from the reactor described in earlier-cited U.S. Pat. No. 5,034,095 which utilizes conical top and bottom reactor sections having convergence angles between 20 and 60 degrees, in contrast to the conical bottom chamber of the present invention which has a convergence angle greater than 60 and less than 90 degrees. These conical sections in U.S. Pat. No. 5,034,095 are essentially open and contain no distribution or discharge devices.

The reactor system of the present invention, which utilizes the unique combination of a simple conical inlet distributor and dilution prior to discharge allows the controlled processing of cellulose pulp at uniform plug flow reactor conditions and eliminates the possibility of plugging during pulp discharge. The system can be used for delignification of virgin pulp or for the removal of color-causing contaminants in pulp prepared from waste paper materials, and is particularly useful in the treatment of such pulps with oxygen.

The essential characteristics of the present invention are described completely in the foregoing disclosure. One skilled in the art can understand the invention and make various modifications thereto without departing from the basic spirit thereof, and without departing from the scope and range of equivalents of the claims which follow.

We claim:

1. A method for the chemical treatment of cellulosic pulp comprising:

(a) introducing a mixture of untreated cellulosic pulp and one or more treatment chemicals axially into a frusto-conical bottom chamber connected to a vertical, cylindrical reactor vessel, wherein said chamber has an inner wall and contains a distributor comprising a cone located coaxially therein, wherein the vertex of said cone is oriented downward;

(b) passing said mixture through the volume between said cone and the inner wall of said bottom chamber and distributing said mixture into said reactor vessel, thereby promoting flow of said mixture upward through said vessel at a constant velocity;

(c) reacting said pulp with said treatment chemicals while said mixture flows upward through said reactor; and (d) withdrawing treated cellulosic pulp from the upper end of said reactor vessel; wherein all the components in said reactor are static and immobile during the introduction and distribution of the mixture, and during chemical treatment of the mixture.

2. The method of claim 1 further comprising repeating steps (a) through (d) in one or more additional treatment stages.

3. The method of claim 1 wherein said untreated cellulosic pulp has a consistency between about 5 and 20%.

4. The method of claim 1 wherein said treatment chemicals, are selected from the group comprising, oxygen, ozone, and sodium hydroxide.

5. The method of 4 wherein the dosage of oxygen to said pulp is between about 0.1 and 5.0 wt % on an oven-dried pulp basis.

6. The method of claim 5 herein the dosage of ozone to sad pulp is between about 0.05 and 1.0 wt on an oven-dried pulp basis.

7. The method of claim 1 wherein the residence time of said mixture in said reactor is between about 45 and 60 minutes.

8. The method of claim 1 wherein said treated cellulosic pulp is diluted by the injection of an aqueous liquid prior to removal from said reactor.

9. The method of claim 8 wherein said dilution is accomplished by injecting said liquid through a plurality of nozzles extending through the head of said vessel, said nozzles being arranged in one or more circular patterns concentric with the axis of said vessel, wherein the nozzles in each individual circular pattern are located at equidistant points on the circumference of said individual circular pattern.

10. The method of claim 9 wherein said nozzles are disposed in said head such that the axis of each nozzle is oriented at an angle of between about 25 and 65 degrees from the tangent to the circle formed by said circular pattern, said tangent being defined at the intersection of the axis Of each nozzle with the outer surface of said head, and further wherein the liquid is discharged from each nozzle in the same circumferential direction relative to said circle-such that the liquiddischarge imparts a circular motion to said pulp around the axis of said vessel.

11. The method of claim 8 wherein the ratio of the pulp consistency after dilution to the pulp consistency before dilution is between about 0.5 to 0.75.

12. The method of claim 1 wherein said untreated cellulosic pulp is prepared from wood chips, and wherein lignin from said wood reacts with oxygen to form reaction products removable in subsequent washing steps.

13. The method of claim 1 wherein said untreated cellulosic pulp is prepared from waste paper material, and wherein lignin and/or contaminants and/or color .bodies from said waste paper material react with oxygen to form soluble and/or suspended reaction products removable in subsequent washing steps.

* * * * *